US005239975A

United States Patent [19]

Mallebrein et al.

[11] Patent Number: 5,239,975

[45] Date of Patent: Aug. 31, 1993

[54] METHOD AND ARRANGEMENT FOR SHIFTING THE LAMBDA MEAN VALUE

[75] Inventors: Georg Mallebrein, Stuttgart; Hans Rossmanith, Stuttgarter, both of Fed. Rep. of Germany

[73] Assignee: Robert Bosch GmbH, Stuttgart, Fed. Rep. of Germany

[21] Appl. No.: 963,396

[22] Filed: Oct. 19, 1992

[30] Foreign Application Priority Data

Oct. 17, 1991 [DE] Fed. Rep. of Germany ..... 4134349

[51] Int. Cl.[5] ..... F02D 41/14

[52] U.S. Cl. ..... 123/696

[58] Field of Search ..... 123/694, 695, 696

[56] References Cited

U.S. PATENT DOCUMENTS

| | | | |
|---|---|---|---|
| 4,137,877 | 2/1979 | Saito | 123/696 |
| 4,210,106 | 7/1980 | Wessel et al. | 123/696 |
| 4,300,505 | 11/1981 | Takada et al. | 123/696 |
| 4,461,258 | 7/1984 | Becker et al. | 123/696 |
| 4,522,180 | 6/1985 | Matsuoka et al. | 123/696 X |
| 4,528,962 | 7/1985 | Auth | 123/696 |
| 5,048,494 | 9/1991 | Fujimoto et al. | 123/696 |

*Primary Examiner*—Willis R. Wolfe
*Attorney, Agent, or Firm*—Walter Ottesen

[57] ABSTRACT

The invention is directed to a method of shifting the lambda value to that value at which a control in time average is effected with a two-point lambda control for an internal combustion engine. The method includes the steps of: forming a control deviation between the current value of a variable, which indicates the lambda value of the engine exhaust gas, and a pregiven fixed value; integrating to form an output variable component with the integration being in the direction of higher integration values in the presence of a control deviation indicating a lean mixture, and in the direction of lower integration values in the presence of a control deviation indicating a rich mixture; temporarily stopping the integration when there is a sign change of the control deviation to that sign which belongs to the desired lambda value shift, the lambda value shift being defined as a stop sign; utilizing an integration stop time span which is then always reset anew when the previous integration stop time span has run; and, permitting an integration stop over the entire integration stop time span when the output variable lies in that value range which belongs to the shift of the lambda mean value in the desired direction. The actual integration stop time span is provided only for the rich region of the control deviation. In this way, an unwanted shift of the lambda mean value in the lean direction does not occur with disturbances.

5 Claims, 7 Drawing Sheets

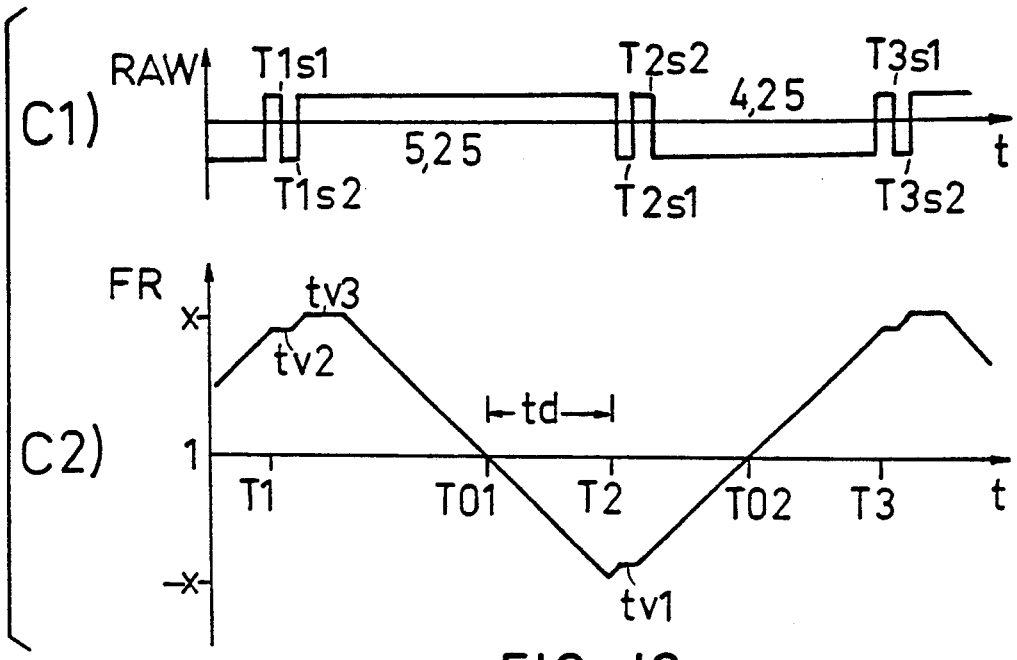
FIG. IC
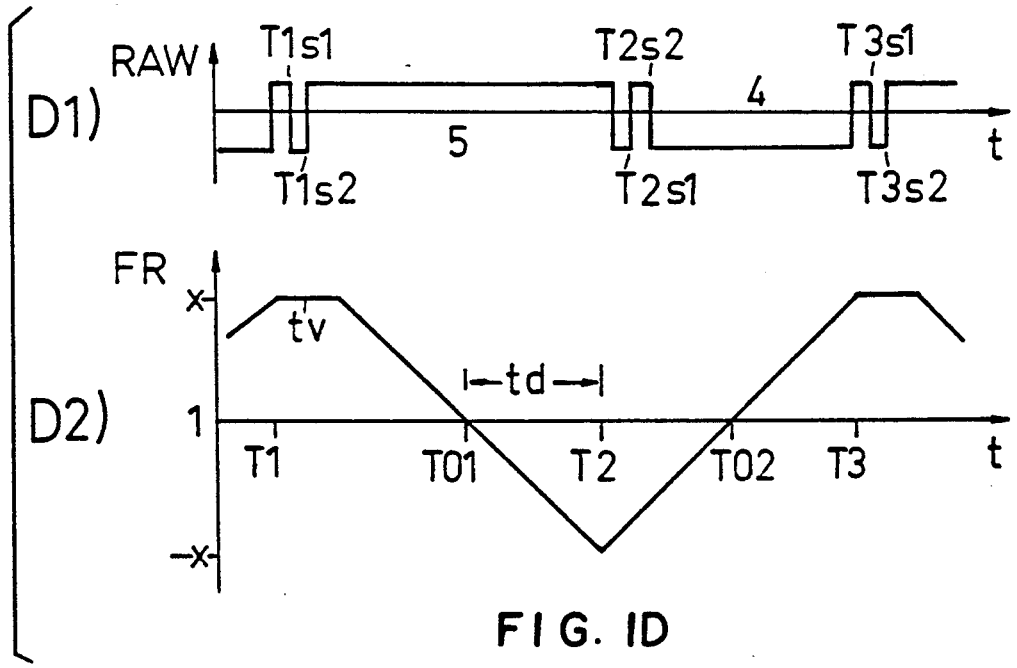
FIG. ID

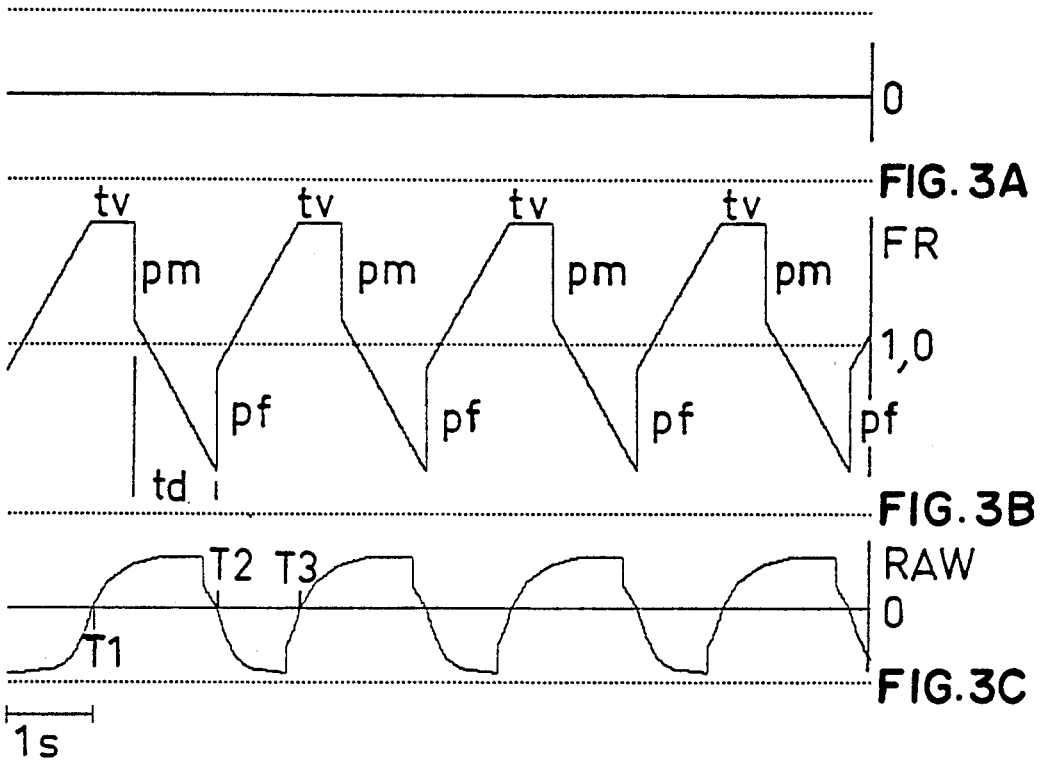
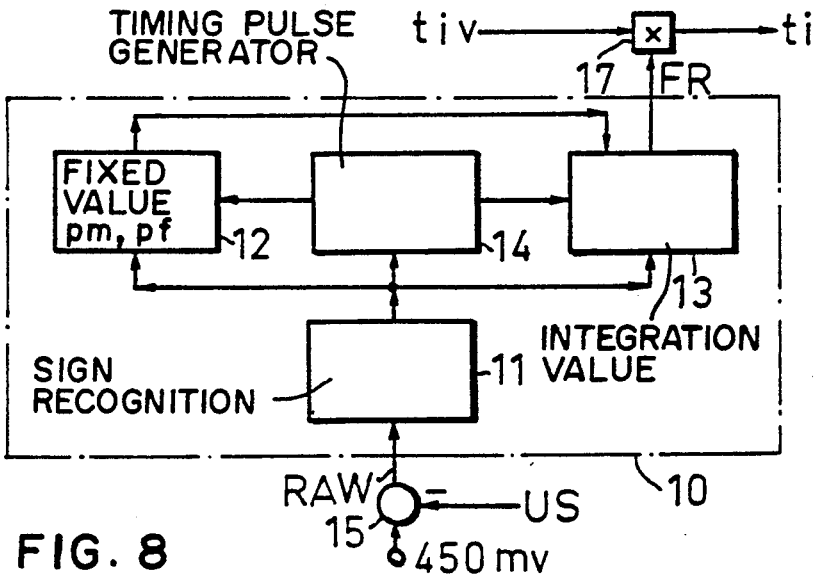
FIG. 8

METHOD AND ARRANGEMENT FOR SHIFTING THE LAMBDA MEAN VALUE

FIELD OF THE INVENTION

The invention relates to a method and an arrangement for shifting the lambda mean value to which the control takes place in the time mean for a two-point lambda control on an internal combustion engine.

BACKGROUND OF THE INVENTION

U.S. Pat. No. 4,210,106 discloses a method of the kind referred to above wherein a control deviation is formed between the actual value of a variable indicating the lambda value of the engine exhaust and a pregiven fixed value; and, wherein an integration to form an actuating variable component takes place with the integration taking place in a direction of higher integration values (enriching) when a lean mixture is present and, when a rich mixture is present, a deviation takes place in the direction of lesser integration values (leaning). For a change of sign of the control deviation to that sign, which belongs to the desired shift of lambda mean value (this is referred to in the following as a stop signal), the integration is delayed for a time and for this purpose an integration-stop time span is used which is always then set anew when the present integration-stop time span has run.

For the purpose of explaining this procedure, it is assumed in the following embodiment and in other embodiments which follow that the lambda mean value should be shifted in the direction "rich" with respect to the lambda value "one". The following all applies to a shift in the lean direction when the terms "rich" and "lean" are exchanged with each other.

The magnitude with which the control deviation is formed is dependent upon the type of the probe used. If the probe supplies a signal which is directly proportional to the lambda value of the measured engine exhaust, then the control deviation is the difference between a pregiven lambda value, especially the value one, and the actual lambda value. If a probe having an intense non-linear relationship (jump response) between probe voltage and lambda voltage is used, the control deviation usually is formed as the difference between a pregiven voltage in the mean voltage range, for example, 450 mV, and the current probe voltage. The value of the voltage pregiven in the mean range is not all that critical since it is only important whether the probe signal just then shows lean or rich.

A lambda controller forms an output value with the aid of the control deviation with the output value usually being a multiplication factor for a precontrol injection time. This multiplication factor has approximately the value one when the precontrol injection time is so selected that this time matches quite precisely the injection time which is necessary for the particular operating state of the engine in order to adjust a lambda value close to one.

The output value, that is the control factor, has at least one integral component. In addition, or also exclusively, a fixed-value component can be used. In the following, the integral component is however decisive.

As long as a fixed component (often referred to as a proportional value) and/or an integral component are used at both sides of the lambda deviation zero, then precisely the lambda mean value one is obtained.

In accordance with U.S. Pat. No. 4,210,106, the procedure followed to shift the lambda mean value provides that fixed values always operate in the direction for obtaining a rich mixture and/or then, when the control deviation shows that after an upward integration (leading to a rich mixture), a downward integration would actually have to follow, the upward integration however is still maintained for a pregiven time duration. As an alternative to these possibilities, and this is not mentioned in this patent, the procedure can be followed that fixed values are added which are utilized in reference to the control deviation zero symmetrically for the formation of the output value which however show different amounts or that the integration value then when the control deviation actually requires a downward integration after an upward integration is no longer increased but rather for a pregiven time span is maintained unchanged. By varying the fixed-value amounts, the integration-stop time spans or also the integration speed, the extent of the mean value shift can be fixed. The parameter values used in each case can be permanently pregiven. However, the parameter values are preferably pregiven in dependence from the particular operating state of the engine at that time, as disclosed in U.S. Pat. No. 4,461,258.

FIG. 3 shows a lambda control of the kind referred to above wherein no disturbances are present for individual cylinders (FIG. 3A) whereas FIG. 4 shows the case of individual disturbances (FIG. 4A) in accordance with the mentioned method. Disturbances individual to a cylinder (often known as chemical noise) occur, for example, in that for a four-cylinder engine, the injection valve for one cylinder enriches the mixtures somewhat more than this applies for the mixture of the three other cylinders. This case is assumed in FIG. 4.

FIG. 3 shows that the control deviation changes the sign from minus to plus at a time point T1 (FIG. 3C) which shows that the mixture changes its composition from lean to rich. The output value FR (FIG. 3B) must act against the foregoing; however, as mentioned above, the obtained output variable value is retained at first for an integration-stop time span tv. After this time span has run, a fixed value jump pm takes place in the lean direction and integration takes place in the lean direction, that is, to a lesser control factor FR. As soon as the actual control factor drops below its neutral value (assumed in the example to be one) integration would actually have to take place in the opposite direction; however, it must be noted that the control factor acts on the injection time and therefore on the mixture composition at the inlet of the engine whereas the change caused thereby is only determined after a dead time td has run, namely at a time point T2 (FIG. 3C) by the oxygen probe mounted in the exhaust-gas flow. A fixed-value jump pf and an integration in the rich direction then takes place directly, that is, without maintaining an integration-stop time span. In this way, a rich mixture is finally again obtained which is determined by the probe delayed, namely at time point T3. This time point corresponds to time point T1 and, for this reason, the sequences described starting at this time point are repeated. Typically, the time span between the time points T1 and T3 is approximately 2 seconds. However, this time span is very dependent upon the distance of the gas outlet from the engine the oxygen probe which is mounted in the exhaust-gas flow and how high the flow velocity (determined by engine speed and load of the engine) of the exhaust gas is.

The above-mentioned neutral value of the control factor is the value at which every small deviation from the same effects a change of the mixture composition toward lean or rich depending upon the sign of the change. The time-dependent mean value $\overline{FR}$ of the control factor FR is influenced by the integration-stop time span tv. This mean value then no longer lies at the neutral value (here "one"); rather, for example, at the value 1.01. The mean value and therefore the lambda mean value can be so adjusted that the exhaust-gas composition falls into the permissible operating range of the catalytic converter used and therefore the toxic gas components are minimized.

From FIGS. 4B and 4C it is directly apparent that the above-mentioned sequence is greatly disturbed when disturbances according to FIG. 4A are present for individual cylinders. In the embodiment shown, the disturbances lead to an unwanted leaning of the time-dependent mean value $\overline{FR}$ of approximately 1% so that on average a control factor FR of approximately one is obtained even though with the aid of an integration-stop time span tv a control factor mean value of approximately 1.01 should actually be adjusted.

The task is then presented to provide a method and an arrangement for shifting the lambda mean value which can essentially ensure the desired shift even in the case of disturbances.

SUMMARY OF THE INVENTION

The method of the invention includes the above-mentioned features and is further characterized in that an integration stop over the entire integration-stop time span essentially takes place only when the output variable lies in that value range which belongs to the displacement of the lambda mean value in the desired direction.

This method is based on the following realization. The integration-stop time span is always triggered for conventional methods when the control deviation indicates a change from rich to lean. However, what is here wanted is an extension of the presence of the output variable in the rich range, that is, in that value range which belongs to the displacement of the lambda mean value in the desired direction. However, it is such that because of disturbances, short-term changes from rich to lean can also then occur when actually a lean mixture is just present. The integration-stop time span is then triggered which leads to an extension of the presence of the output variable in the lean range even though the integration-stop time span is actually not provided therefor. Because the integration stop does not take place with each change from rich to lean in the method of the invention, but only when the integration stop contributes to an extension of the presence of the output variable in the rich range, the conventional unwanted intense lean displacement in the case of disturbances is avoided. At the same time, the control performance is significantly more regular. This is immediately apparent by comparing the signal traces **5*b* and 5*c*, which are recorded for a method according to the invention, to the explained traces of FIGS. 4B and 4C**, respectively.

The simulated signal traces according to FIG. 5 are obtained with a method which realizes the above-mentioned general teaching in that the integration is stopped only for such component time spans in which the following conditions are fulfilled: the sum of the last component time spans since the run of the last integration-stop time span and the actually-running component time span have not yet reached the integration-stop time span; and, the sign of the control deviation is the stop sign.

With this method, the general condition is indirectly fulfilled with the aid of the sign check for the control deviation that the output variable lies in that range which belongs to the displacement of the lambda mean value in the desired direction so that an integration stop can take place. This method leads to short integration stops even in the lean range, however, these at times occurring short stops do not have negative effects in practice which can be seen from a comparison of the simulation FIGS. 4 and 5 to which reference has already been made. This method affords the advantage that it is realizable with the least computation complexity since only the sign of the control deviation is to checked in order to make decisions.

More precise, but substantially more complex as to computations is the method wherein the integration is stopped over the entire integration stop time span as soon as the sign of the control deviation changes to the stop sign and the output variable lies in that value range referred to the neutral value of the output value which belongs to the displacement of the lambda value in the desired direction and the integration is not stopped so long as the output variable lies on the other side of the neutral value of the output variable.

The arrangement according to the invention for shifting the lambda mean value includes the following units: a subtraction unit for forming the control deviation between the actual value of a variable showing the lambda value of the engine exhaust gas and a pregiven fixed value; an integration unit for forming an output-variable component with the integration taking place in the direction of higher integration values (enriching) when this control deviation shows the presence of a lean mixture and in the direction of lower integration values (leaning) when the control deviation shows a rich mixture and the integration is stopped temporarily for a sign change of the control deviation to the stop sign; and, a time-generator unit for pregiving an integration-stop time span for the particular stopping of the integration which integration-stop time span is then always set anew when the previous integration-stop time span has run; the integration unit and the time-generator unit are so configured that an integration stop over the entire integration-stop time span takes place essentially only when the output variable lies in that value range which belongs to the displacement of the lambda value in the desired direction.

Preferably the arrangement is so configured that the integration unit and the time-generator unit are so configured that the integration is stopped only for such component time spans in which the sum of the last component time spans has not yet reached the integration-stop time span since the run of the last integration-stop time span and the actually-running component time span and the sign of the control deviation is the stop sign.

BRIEF DESCRIPTION OF THE DRAWINGS

The invention will now be described with reference to the drawings wherein:

FIGS. 1A1 to 1D2 each show a pair of time-correlated displays of the signal traces of the control deviation and of a control factor for a control without disturbances in accordance with the method of the invention (solid line) and a known (broken line) method A, for a known method having disturbances B, a first method of the invention having disturbances C and a second method of the invention having disturbances D;

FIGS. 2A1 to 2D2 show signal traces corresponding to those of FIG. 1 but for methods wherein a fixed-value component in the control factor is used in addition to an integral component;

FIGS. 3A to 3C show signal traces already mentioned for a known method without disturbances;

DESCRIPTION OF THE PREFERRED EMBODIMENTS OF THE INVENTION

Figure 1A:
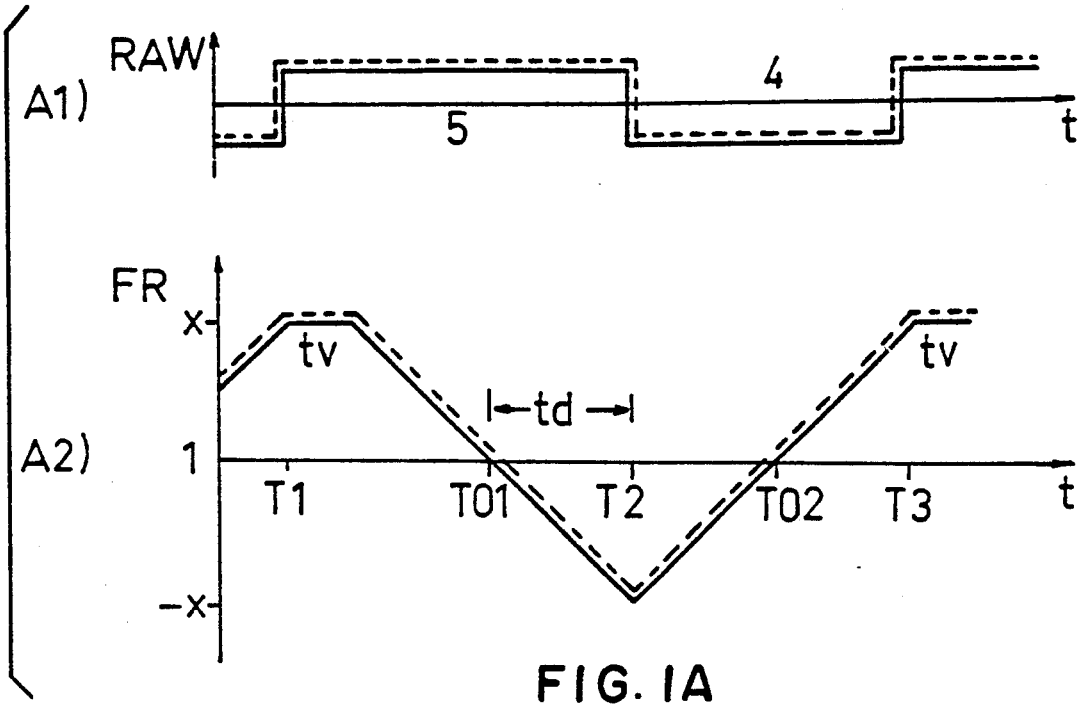

Time units are referred to in the descriptions of FIGS. 1 and 2. If each time unit is set equal at 200 ms, then quite realistic values result, namely approximately 200 ms for the integration-stop time span tv, 400 ms for the dead time span td and, for example 1.8 seconds for the period of the control swing in the case of FIG. 1A. It is noted that conventional values for the integration-stop time span tv and also for the fixed-value jumps pf, pm (see FIG. 2) can be used. What is essential for the embodiments is only the manner in which the integration stops are treated.

The signal traces of the control deviations RAW as jump functions are shown in FIGS. 1 and 2. Actually, the jump edges are greatly rounded and this can be recognized already from the simulation of the above-mentioned FIG. 3C and in practice, this is still more intensely pronounced since the probe itself has a low-pass response whereby, for example, the sharp drops present in FIG. 3 from rich in the lean direction are precluded.

According to FIG. 1A1, the control deviation RAW changes its sign from minus to plus at a time point T1. The positive deviation indicates a rich mixture and the negative deviation indicates a lean mixture. The control factor FR of FIG. 1A2 is intended to act against this jump; however, this does not take place directly but only after an integration-stop time span tv has expired. Here it is a condition precedent that the lambda mean value for the control is intended to be shifted slightly in the desired manner in the rich direction. For this reason, the high lambda value obtained at time point T1 is somewhat maintained in order to extend the time for the injection of the rich mixture. As soon as the control factor FR, which is reduced after expiration of the integration-stop time span tv, is so great (at time point TO1), that this control factor ensures a lean mixture for the injection, the dead time span td starts, at the end of which (time point T2) a lean exhaust-gas mixture reaches the oxygen probe. It is now intended to again control in the rich direction. This takes place also directly, that is, without maintaining an integration-stop time span tv. The control factor FR increases because of the integration and again reaches (at time point T02) the value at which the character of the mixture changes, this time from lean to rich, at which time point the dead time span td again starts running. With the expiration of the dead time span td at time point T3, the oxygen probe again detects the presence of a rich mixture, as previously at time point T1, whereupon the sequence described is repeated starting with time point T1.

The above time play applies for a conventional method as well as for the method of the invention since no disturbances occur which would first effect different performance. The signal traces for the known method (broken line) and the method of the invention (solid line) are therefore identical. The time span between the time points T1 and T2, that is for the time during rich, amounts to four time units and the time span between the time points T1 and T3 (that is for the lean range) amounts to five time units. As time-dependent mean values $\overline{FR}$ for this example $1+x/9$ was computed with x being the control stroke of the integrator in the lambda controller obtained during the dead time td.

It will be explained with respect to FIG. 1B how a conventional method reacts when disturbances occur. Disturbances are assumed in such a manner that the control deviation after a sign change, after a long presence with the other sign, changes its sign several times relatively rapidly. In all embodiments according to FIGS. 1 and 2, each short change takes place after a quarter time unit and at time points which are shown by s1 and s2, that is, after the time point T1, that is T1s1 and T1s2.

Figure 1B:
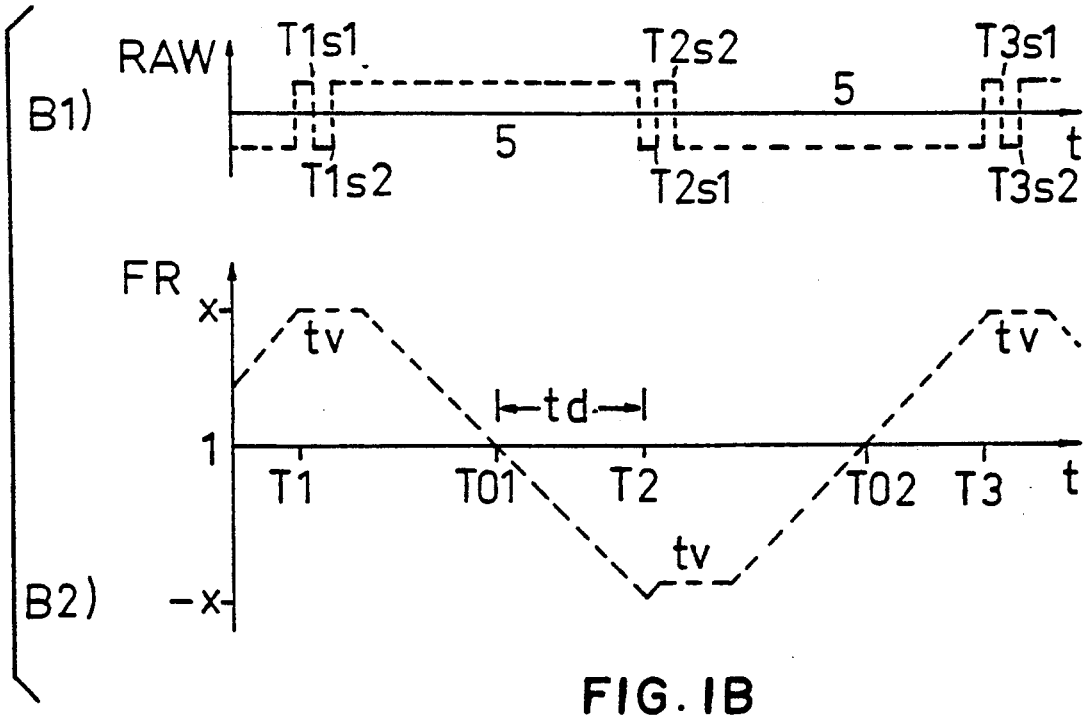

According to FIG. 1B2, at time point T1, as is also the case of the trace of FIG. 1A2, the integration-stop time span tv is set. The short-term disturbance directly after the time point T1 remains therefore unnoticed and for this reason, the time point T2 is reached via the time point T01 as in the case of FIG. 1A. At time point T2, the control deviation changes from rich to lean and, for this reason, the integration to greater control-factor values is begun. Already a quarter time span later, a change from lean to rich takes place however at time point T2s1. This immediately triggers the start of the integration-stop time span. Only after this time span has run, does the integration to greater control factors continue. Because of the integration stop in the lean region, the presence of the control factor in the lean region is extended, namely, from four to five time units in the illustrated and explained embodiment. The mean value $\overline{FR}$ of the control factor is also changed and therefore the lambda mean value. For FIG. 1B2, $\overline{FR}=1+x/80$ is computed. This means that the actually wanted rich displacement is reversed in an unwanted manner because of the disturbances (rich shift of $0.012 \cdot x$ compared to $0.111 \cdot x$ in the undisturbed case).

The above-mentioned disadvantage is avoided by the embodiments of the invention shown in FIGS. 1C and 1D.

When, according to FIG. 1C, a change of the sign of the control deviation RAW takes place at time point T1 from lean to rich (minus to plus), then the integration-stop time span is started. The integration is however immediately continued as soon as the reverse change takes place at the time point T1s1 (after a component time span tv1). The integration is again stopped when a new change from lean to rich takes place at time point T1s2. The integration is now stopped for so long until the remainder tv3 of the integration-stop time span tv has run. Overall, the integration-stop time span tv is made up of three component time spans tv1 (only illustrated later on), tv2 and tv3. The control factor is reduced by integration with the expiration of the integration-stop time span tv until the time point T2 is again reached via the time point T01 wherein the oxygen probe again determines a lean mixture. The direction of integration is immediately reversed; however, at time point T2s1, a stop again takes place as in the case of FIG. 1B2. However, the integration is not stopped for the entire integration-stop time span; instead, only (for a time span t1') until the renewed change from rich to lean at time point T2s2. Now, the control deviation RAW indicates finally a lean mixture and for this reason the control factor is continuously integrated upwardly in the rich direction until the time point T3 is reached via the time point T02. In this case, integration stops also exist in the lean region; however, not over the entire integration-stop time span tv; instead, only over the component time span tv1'. A control-factor value $\overline{FR}$ of $1+(1.125/9.5)\cdot x$ in accordance with the computed example adjusts, that is, a rich shift of $0.118\cdot x$ in the undisturbed case.

With the embodiment of FIG. 1B, it is ensured that no extensions of the dwell time of the control factor in the lean region take place because of disturbances. This is done in a manner different than in the embodiment of FIG. 1C. Here, the integration-stop time span tv is not subdivided into individual segments independently of whether the control factor lies in the rich or in the lean region; instead, the time span is applied as a unit, however, only in the rich range. The total integration time span tv is started when the time point T1 is reached as described for FIG. 1A. After the integration-stop time span tv has run, the further signal trace up to the time point T2 is identical. There, the integration direction reverses; however, a problem occurs a short time later when at the time point T2s1, a change in the control deviation from lean to rich takes place. This change triggered a short integration stop in all previous embodiments. In the embodiment of FIG. 1D, a check is however made as to whether the control factor FR lies in the rich or in the lean range. This can, for example, take place in that a check is made as to whether the control factor is greater than one (rich) or less than one (lean). Another possibility is that the actual value is compared to a sliding mean value. If the determination is made that the control factor lies on that side (here lean at time point T2s1) which is opposite that side in which the lambda value is intended to be shifted (here rich) then no integration stop takes place. The same check with the same result must take place once more at time point T2s3. Since in both cases, the result is that the integration to greater values is not to be stopped, then the signal trace follows the signal trace as described with respect to FIG. 1A. Accordingly, the same mean value results for the control value FR as in the undisturbed case, $\overline{FR}=1+x/9$ with the rich shift $0.111\cdot x$.

The signal traces of FIGS. 2A1 to 2D2 are very similar to those of FIGS. 1A1 to 1D2 with the difference being that the control factor FR is not changed only by integration but also with the aid of two fixed-value jumps pm and pf in mutually opposite directions but with opposite sign and of the same magnitude. The fixed-value jump pm follows after expiration of the integration-stop time span tv in the rich range to change in the lean direction. The corresponding counterjump in the rich direction always then continues when the integration direction reverses from an integration lean directly into one in the rich direction. For a change from an integration stop into an integration in the rich direction, the fixed-value jump pf is not used. The amount of the fixed-value jumps corresponds in the embodiment each to one quarter of the total stroke of the control factor for the undisturbed case.

Under the above conditions, the following time-dependent mean values for the control factor result: $1+x/7$, that is a rich shift of $0.143\cdot x$ for the case without disturbances for a known method as well as for the method of the invention; $1+(5/64)\cdot x$, that is, a rich shift of $0.078\cdot x$ and therefore a considerably reduced shift than wanted in the case of disturbances in the known method; $1+(3/20)\cdot x$, that is, a rich shift of $0.15\cdot x$ and therefore an enrichment minimally greater than wanted in the case of the method of the invention of FIG. 2C with the subdivided integration-stop time span in the rich as well as in the lean; and $1+x/7$, that is a rich shift of $0.143\cdot x$ in the case of the second embodiment of the invention according to FIG. 2D with an application of the integration-stop time span only when a jump in the control deviation from lean to rich takes place and, in addition, the control factor lies in the rich range.

Figure 2A:
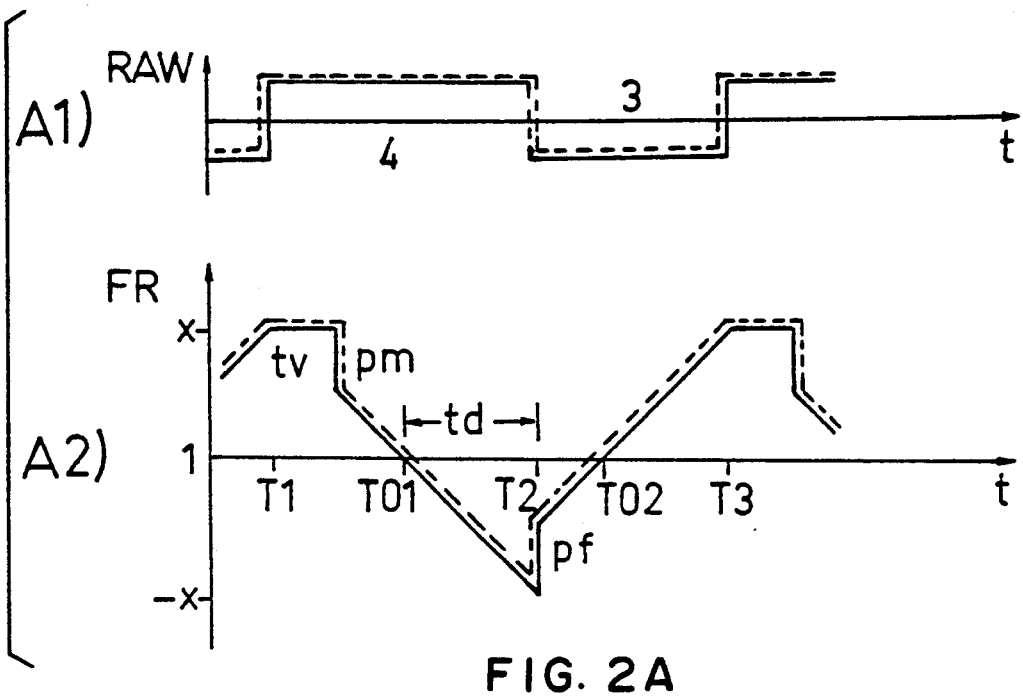
Figure 2B:
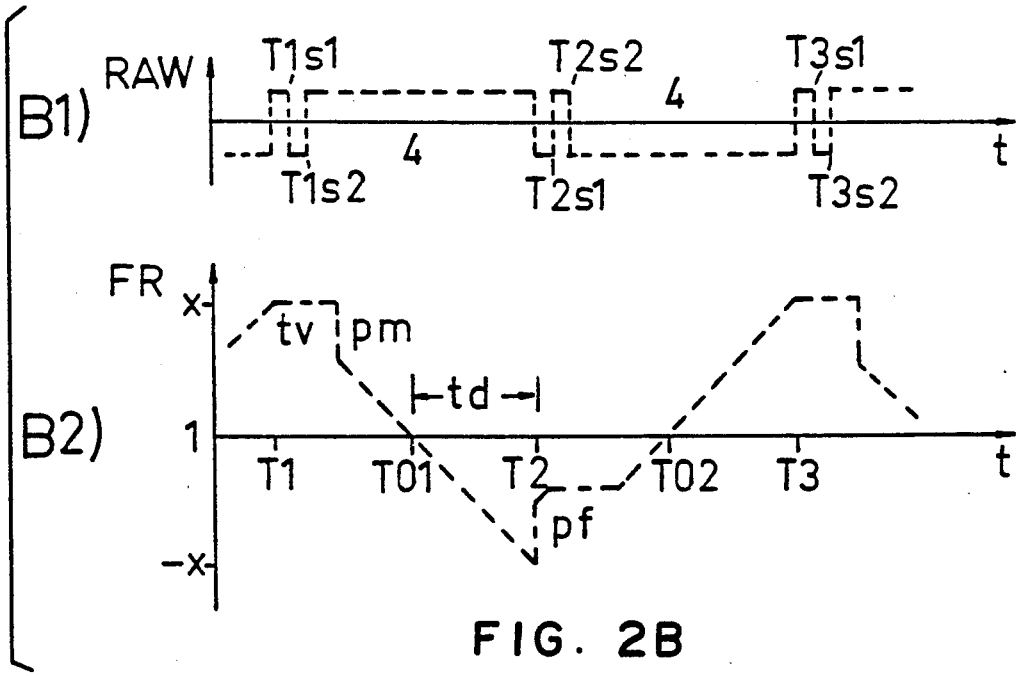
Figure 2C:
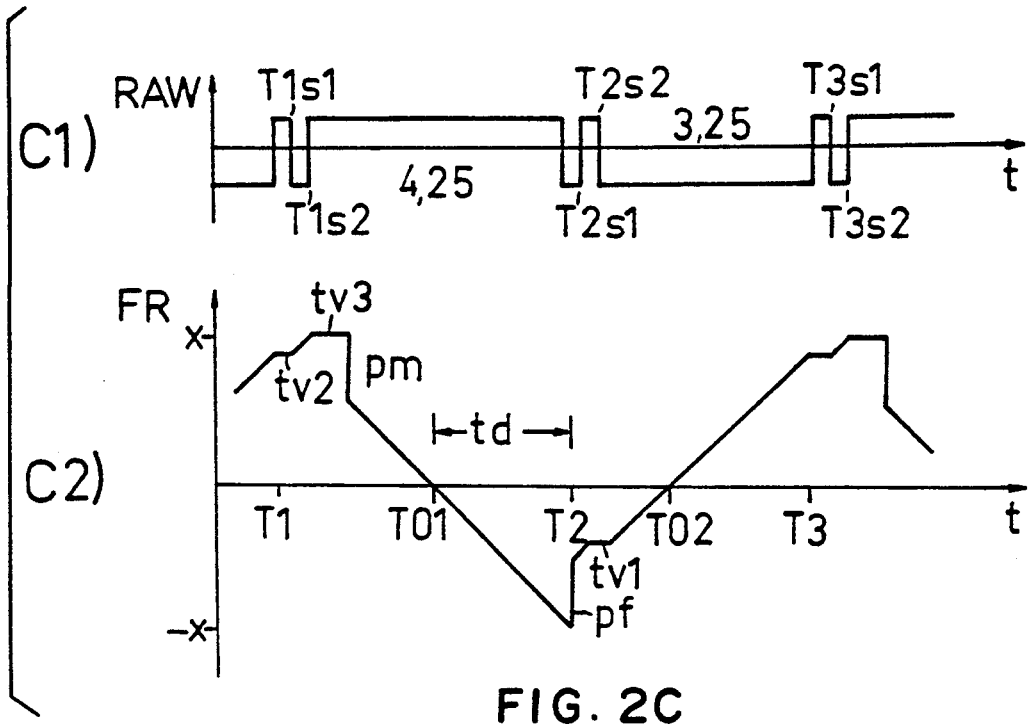
Figure 2D:
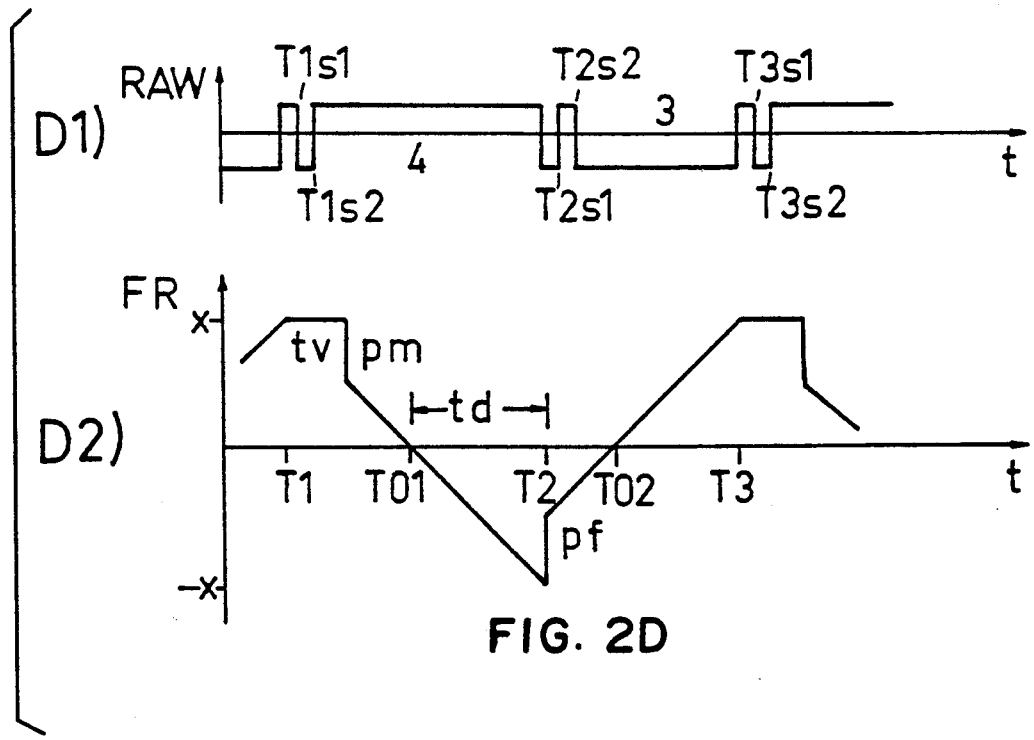
Figure 4A:
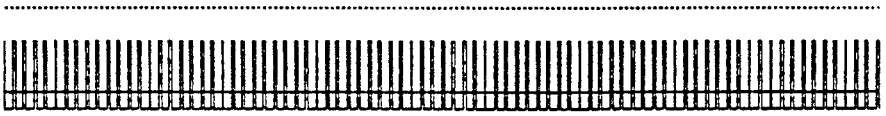
FIGS. 4A to 4C show already-mentioned signal traces for the known method according to FIG. 3 but with disturbances.
Figure 4B:
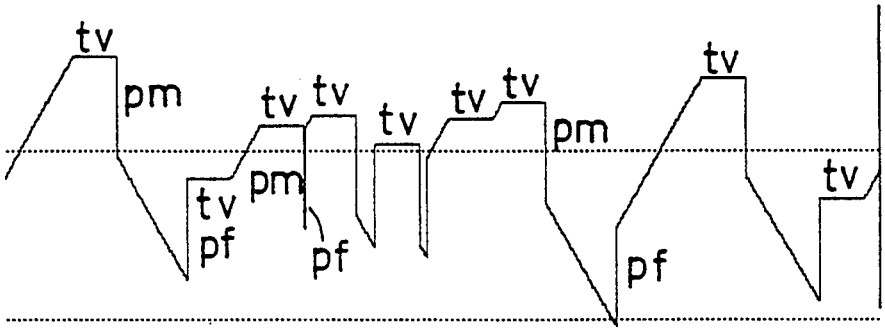
Figure 4C:
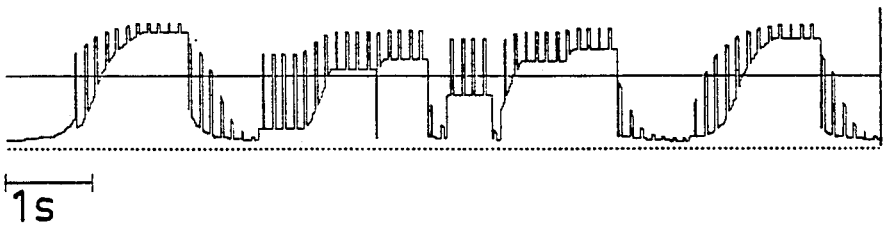
Figure 5A:
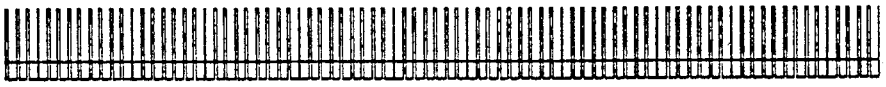
FIGS. 5A to 5C show signal traces already mentioned and corresponding to those of FIG. 4 but for a method of the invention.
Figure 5B:
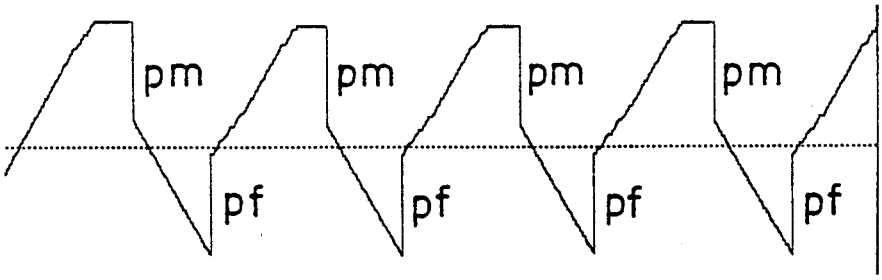
Figure 5C:
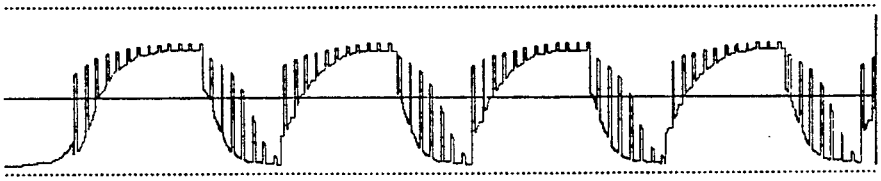

An unwanted slight enrichment takes place in each of the embodiments of FIGS. 1C and 2C. This results because the intermittent integration in rich during the interruptions of the integration-stop time span has greater effects than the short-term integration-stop component time spans in lean. Whether finally an unwanted slight enrichment or leaning takes place is dependent on the integration constant used but also on different disturbances in the lean and in rich. On the average, however, the last-mentioned differences are usually not present and the integration time constants and the disturbance time spans are in such a relationship to each other so that as a rule, a slight enrichment occurs. Simulations show that the unwanted enrichment actually lies in an order of magnitude as shown in the examples of FIGS. 1C and 2C. However, if even such small disturbances are to be prevented, numerous solutions are present which all act to block smaller changes in the rich direction but permit those in the lean direction. Two embodiments for this purpose are explained with respect to FIGS. 6 and 7 for digital integration.

Figure 6A:
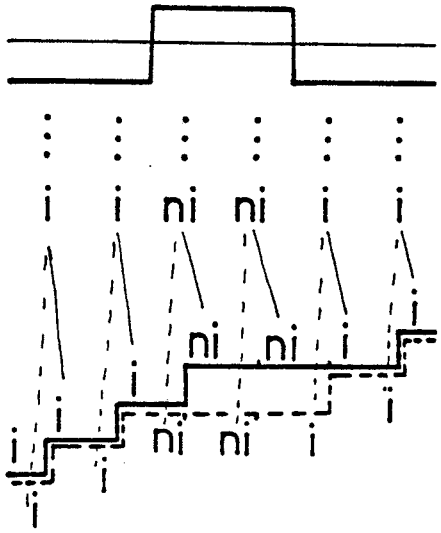
FIGS. 6A and 6B are provided for explaining how different digital integration methods act on a lambda value shift.
Figure 6B:
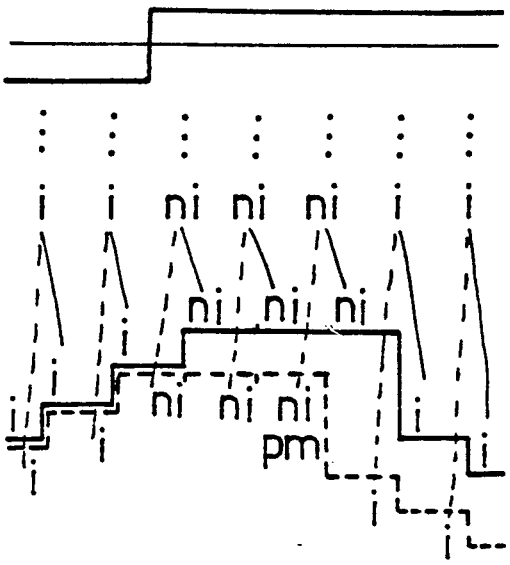
Figure 7:
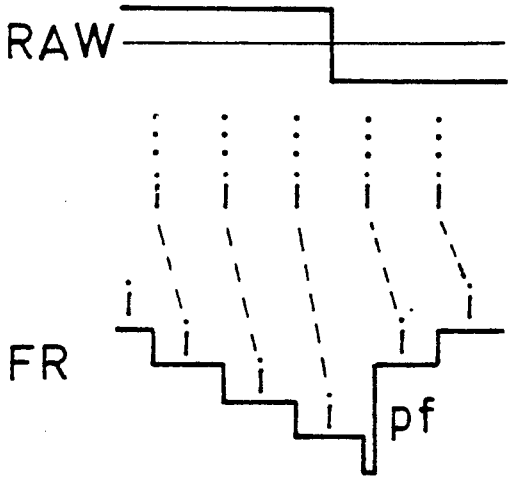
FIG. 7 is provided for explaining how a digital integration value and a fixed value act on a shift of the lambda value; and, FIG. 8 is a block diagram of an arrangement according to the invention.

In each of FIGS. 6 and 7, the uppermost signal line defines the control deviation RAW. Under this signal line, vertical dot lines characterize the time points at which a scanning of the control deviation and a new computation of the control factor FR is carried out. As known from the description above, integration is to take place with the presence of certain conditions, and with the presence of other conditions, no integration is to be made. For digital integration, two possibilities are present in order to consider a non-integration. The first is the one wherein at a time point where it results that it should not be integrated, this non-integration is referred to the following time span up to the next scanning. This embodiment results in the solid line for the control factor FR in FIGS. 6A and 6B. The other embodiment is that this information is referred to the time span which has just passed. This results in the dotted traces in the above-mentioned figures. In most cases, the same integration result results, independently whether the non-integration condition is referred to the past time span or the next time span. This typical case is shown in FIG. 6A. A special case however occurs when the integration direction changes and this change is preceded by a non-integration computation time span.

Then an integration in the previous integration direction is lost. This case is shown in FIG. 6B. This case occurs in the embodiments of FIGS. 1C and 2C only when there is a change from the rich direction to the lean direction and leads to an increment more in the lean direction when the non-integration information is referred to the previous time span. A slight leaning can then be caused.

The embodiment of FIG. 7 relates to a jump in the control deviation from rich to lean. Accordingly, integration to smaller values of the control factor FR first takes place. It is assumed in FIG. 7 that the information that integration should occur always comes from the computer time span which has run. As soon as the change from rich to lean is determined, a jump in the control factor FR by a fixed value pf in the rich direction takes place. Normally, with a jump of this kind, the integration value resulting from the previous computer time span is shifted from the lean direction is discarded. However, if this is not done, the possibility is present to produce a very small lean shift.

The block diagram of FIG. 8 shows an arrangement for carrying out the method described above. This arrangement comprises a controller 10 having a sign detecting unit 11 which emits its signals to a fixed value output unit 12, an integration value computation and output unit 13 and a clock 14. The fixed value output unit 12 receives the output signal from the clock 14 in order to decide, in accordance with one of the above-described methods, whether it should emit the fixed value pm or the fixed value pf. The clock 14 permits the integration stop time span to continue to run when a sign change from rich to lean occurs. As soon as the sum of all expired component time spans and the running component time span reach the set integration stop time span, the integration stop is removed and the integration stop time span is reset anew.

The sign detection unit 11 evaluates a control deviation signal RW which is formed by a subtraction element 15. The subtraction element subtracts a fixed voltage of 450 mV (shown in the embodiment) from a voltage US as it is supplied by an oxygen probe. This voltage is significantly less than 450 mV in the lean range and is significantly greater in the rich range. When the lambda value is used directly as a variable for forming the control deviation, the actual value in each case is subtracted from the fixed value in order, in turn, to obtain in rich positive and in lean negative values of the control deviation RAW.

The output signal of the fixed value output unit 12 is added in the integration unit 13 to the integration values at the time points defined above in the method sequence and the value obtained in this way is emitted as the control factor FR. This control factor is multiplied in a multiplication unit 17 by a precontrol injection time tiv and this results in the actual injection time ti.

It is to be noted that in the block diagram of FIG. 8 all details known to the state of the art are omitted which are not significant with respect to the invention. Accordingly, it is not shown how the precontrol injection time tiv is obtained and how this time is adapted to other operating conditions and how parameters of controller 10, especially the integration stop time span tv and the fixed values pm and pf are changed in dependence upon the operating state of the controlled engine.

It is understood that the foregoing description is that of the preferred embodiments of the invention and that various changes and modifications may be made thereto without departing from the spirit and scope of the invention as defined in the appended claims.

What is claimed is:

1. A method of shifting the lambda value to that value at which a control in time average is effected with a two-point lambda control for an internal combustion engine, the method comprising the steps of:

forming a control deviation between the current value of a variable, which indicates the lambda value of the engine exhaust gas, and a pregiven fixed value;

integrating to form an output variable component with the integration being in the direction of higher integration values (enrichment) in the presence of a control deviation indicating a lean mixture, and in the direction of lower integration values (leaning) in the presence of a control deviation indicating a rich mixture;

temporarily stopping the integration when there is a sign change of the control deviation to that sign which belongs to the desired lambda value shift, said lambda value shift being defined as a stop sign;

utilizing an integration stop time span which is then always reset anew when the previous integration stop time span has run; and, permitting an integration stop over the entire integration stop time span when the output variable lies in that value range which belongs to the shift of the lambda mean value in the desired direction.

2. The method of claim 1, comprising the further step of: stopping the integration always only for such subtime spans wherein the following conditions are fulfilled: the sum of the last subtime spans since the last integration stop time span has run and the current running subtime span has not yet reached the integration stop time; and, the sign of the control deviation is said stop sign.

3. The method of claim 1, comprising the further step of stopping the integration over the entire integration stop time span as soon as the sign of the control deviation changes to said stop sign and the output variable lies in that value range referred to the mean value of the output variable, the value range belonging to the shift of the lambda value in the desired direction; and, not stopping the integration as long as the output variable lies on the other side of the mean value of the output value.

4. An arrangement for shifting the lambda value to that value at which a control in time average is affected with a two-point lambda control for an internal combustion engine, the arrangement comprising:

subtraction means for forming a control deviation between the current value of a variable indicating the lambda value of the exhaust gas and a pregiven fixed value;

integration means for forming an output variable component with the integration taking place in the direction of higher integration values (enriching) when a control deviation is present indicating a lean mixture and with the integration taking place in the direction of lower integration values (leaning) when a control deviation is present indicating a rich mixture; and, means for temporarily stopping the integration for a change in sign of the control deviation to that sign which belongs to the desired lambda value shift defined as a stop sign;

timing pulse generator means for setting an integration stop time span for the temporary stopping of the integration, the integration stop time span always being set anew when the previous integration stop time span has run; and, said integration means and said timing pulse generator means being so configured that an integration stop over the entire integration stop time span essentially only takes place when the output variable lies in that value range which belongs to the shift of the lambda mean value in the desired direction.

5. The arrangement of claim 4, said integration means and said timing pulse generator means being so configured that the integration is always stopped only when for such subtime spans wherein the sum of last subtime spans since the last integration stop time span has run and the currently running subtime span has not yet reached the integration stop time span and the sign of the control deviation is said stop sign.

* * * * *